US005972094A

United States Patent [19]

Bates et al.

[11] Patent Number: 5,972,094

[45] Date of Patent: Oct. 26, 1999

[54] SIZING COMPOSITION

[75] Inventors: Robert Bates, Amersfoort; Gerard J. Broekhuisen, Arnhem; Edwin R. Hensema, Voorthuisen; Malcolm J. Welch, Hoevelaken, all of Netherlands

[73] Assignee: Hercules Incorporated, Wilmington, Del.

[21] Appl. No.: 08/861,925

[22] Filed: May 22, 1997

[30] Foreign Application Priority Data

May 24, 1996 [GB] United Kingdom ..... 96 10955

[51] Int. Cl.[6] ..... C08L 3/04; C08L 93/04; C09D 103/04; C09D 193/04

[52] U.S. Cl. ..... 106/145.1; 106/145.2; 106/145.4; 106/213.1; 106/214.2; 106/215.2; 106/215.3; 106/215.4; 524/25; 524/47; 524/52

[58] Field of Search ..... 106/213.1, 215.4, 106/218, 145.1, 145.2, 145.4, 214.2, 215.2, 215.3; 524/25, 47, 52

[56] References Cited

U.S. PATENT DOCUMENTS

| | | | |
|---|---|---|---|
| 2,539,183 | 1/1951 | Child | 92/21 |
| 2,566,529 | 9/1951 | Montgomerie | 106/144 |
| 3,582,464 | 6/1971 | Aldrich | 162/180 |
| 3,906,142 | 9/1975 | Dowthwaite et al. | 428/498 |
| 3,966,654 | 6/1976 | Aldrich | 260/24 |
| 4,240,935 | 12/1980 | Dumas | 260/9 |
| 4,263,182 | 4/1981 | Aldrich | 260/9 |
| 4,323,425 | 4/1982 | Dowthwaite et al. | 162/168 |
| 4,374,673 | 2/1983 | Aldrich | 106/212 |
| 4,522,686 | 6/1985 | Dumas | 162/158 |
| 4,842,691 | 6/1989 | Nakajima et al. | 106/215.4 |
| 4,983,257 | 1/1991 | Schultz et al. | 162/158 |
| 5,382,282 | 1/1995 | Pennaz | 106/218 |

FOREIGN PATENT DOCUMENTS

| | | |
|---|---|---|
| 1045735 | 1/1979 | Canada . |
| 1057467 | 7/1979 | Canada . |
| 746061 | 11/1996 | Canada . |
| 686727 | 12/1995 | European Pat. Off. . |
| 0 763 628 | 3/1997 | European Pat. Off. . |
| 49-1247 | 1/1974 | Japan . |
| 7-120958 | 5/1995 | Japan . |
| 7109360 | 5/1995 | Japan . |
| 678636 A5 | 10/1991 | Sweden . |
| 1210675 | 10/1970 | United Kingdom . |

*Primary Examiner*—David Brunsman
*Attorney, Agent, or Firm*—Martin F. Sloan; Mark D. Kuller

[57] ABSTRACT

This invention relates to a sizing composition comprising a thermoplastic resin selected from the group consisting of thermoplastic rosins having an acid number less than 50, thermoplastic hydrocarbon resins, thermoplastic polyamides and thermoplastic amide waxes, its use in sizing paper and paper sized with the sizing agent. The invention also relates to a method of sizing paper comprising use of a composition comprising a thermoplastic rosin, wherein the sizing takes place substantially in the absence of alum, and paper so sized.

17 Claims, 3 Drawing Sheets

SIZING COMPOSITION

FIELD OF THE INVENTION

The present invention relates to compositions suitable for use as sizing agents and the use of such compositions for sizing paper. In particular, the present invention relates to thermoplastic resins and their use for sizing paper.

BACKGROUND OF THE INVENTION

While there are a myriad of details for manufacturing paper, the paper manufacturing process conventionally comprises the following steps: (1) forming an aqueous suspension of cellulosic fibers, commonly known as pulp; (2) adding various processing and paper enhancing materials, such as strengthening and/or sizing materials; (3) sheeting and drying the fibers to form a desired cellulosic web; and (4) post-treating the web to provide various desired characteristics to the resulting paper, including surface application of sizing materials, and the like.

Sizing materials are typically in the form of aqueous solutions, dispersions, emulsions or suspensions which render the paper treated with the sizing agent, namely sized paper, resistant to the penetration or wetting by an aqueous liquid, including other treatment additives, printing inks, and the like.

A sizing agent may be applied to the surface of paper as a "surface" size or may be incorporated within the paper as an "internal" size. Various agents are known to be suitable for sizing paper.

U.S. Pat. No. 4,374,673 describes aqueous dispersions which consist essentially of finely-divided fortified rosin particles, a water-soluble or water-dispersible cationic starch dispersing agent for the finely-divided fortified rosin particles, an anionic surface active agent; and water. The aqueous dispersions disclosed therein are used to size paper.

U.S. Pat. No. 4,263,182 describes aqueous dispersions which consist essentially of finely-divided fortified rosin particles; a water-soluble or water-dispersible cationized starch dispersing agent for the finely-divided fortified rosin particles; an anionic surface-active agent; and water. The aqueous dispersions may also be used to size paper.

U.S. Pat. No. 3,966,654 describes essentially stable aqueous dispersions of fortified rosin which consist essentially of fortified rosin in finely-divided form and a water-soluble cationic resin. In an example a water-soluble cationic aminopolyamide-epichlorohydrin resin is shown to be used as the cationic resin. The fortified rosin dispersion is used to size paper.

Canadian Patent Application 746,061 describes paper sizing compositions comprising rosin, and the reaction product of an acidic compound containing a >C═C—C═O with a dimer of an acyclic terpene having three double bonds per molecule; the mixture being at least partially neutralised with aqueous alkali. Suitable terpenes include alloocimene, ocimene or myrcene which may be dimerised using phosphoric acid. The acid compounds are α, β-unsaturated carboxylic acids such as maleic or fumaric acid.

Canadian Patent Application 1,045,735 describes a dispersion of enriched rosin containing (A) 5–50 wt % of enriched rosin, (B) 0.5–10% of a water-soluble cationic resin dispersant which is (a) a polyaminopolyamide-epichlorohydrin resin, (b) an alkylene-polyamine-epichlorohydrin resin, or (c) a poly(diallylamino)-epichlorohydrin resin, and (C) water to 100%. The dispersions do not need the addition of (enriched) rosin soap or stabilizers.

Canadian Patent Application 1,057,467 describes the preparation of a stable, aqueous dispersion of a colophony-based material in the presence of an anionic dispersant. The process comprises homogenizing an unstable aqueous dispersion containing by weight, 25–30% solids, consisting, by weight, of 0–95% colophony and of 100–5% adduct of colophony and of an acid compound containing a C═C—C═O group. Homogenization is effected under 141–562 atmosphere excess pressure, at 125–180° C. The anionic dispersant may be a saponified colophony-based material, and/or a synthetic emulsifier e.g., alkylaryl sulphonate salt. The dispersion may used in sizing cellulosic fibres for paper manufacture, using "internal" or "external" sizing methods. Paper sheets have improved resistance to penetration of water and aqueous ink.

U.S. Pat. No. 4,983,257 describes an invert size for the engine and tub sizing of paper. It contains an aqueous dispersion of a fortified, unfortified, hydrogenated, or disproportionated and optionally esterified rosin or mixture of such rosins and of a dispersant that contains digested casein or an emulsifier of the general formula $(R—(OCH_2CH_2)n—O—A)_x—M^{x+}$ wherein R is an alkylphenyl, alkyl, or alkenyl group or a cycloalkyl group with condensed rings, A is a group with the formula $—CH_2COO$ or $—SO_3$, $M^{x+}$ is a cation, x is 1 or 2, and n is a number such that approximately 21 to 76% of the molecular weight of the anion is in the $—OCH_2CH_2$ group. To allow sizing control, the dispersant contains cationic starch.

European Patent Application EP-A-0686727 describes a sizing material for surface and internal sizing comprising an aqueous dispersion of rosin with starch and a lignin sulphonate. Also described is a process for the production of the size by mixing the rosin with the other components under high shear conditions, such as in a high pressure homogeniser or by stirring with a speed of at least 2000 r.p.m. The document describes a surface and internal size for paper for use in the pH range of 4.5–8.5.

Japanese Patent Application 45-124221 (124221-1970) (Publication No. 49-1247) describes the preparation of an alkyd resin from a rosin, a polyhydric alcohol and an aromatic carboxylic acid.

Japanese Patent Application 3-348085 (348085-1991) (Publication No. 7-120958) describes the manufacture of paper treated with a sizing agent comprising (i) a rosin, (ii) a polyhydric alcohol and (iii) an α, β-unsaturated carboxylic acid derivative, wherein the ratio of hydroxyl group equivalents of (ii) to the carboxyl group equivalents of (i) introduced lies in the range 0.1 to 1.5.

Japanese Patent Application 5-277796(27796-1993) (Publication No. 7-109360) describes production of resin emulsions by emulsifying into water with use of an emulsifier at least one rosin ester, terpene based resin or petroleum resin. The emulsifier is a copolymer produced by copolymerizing (A) 30–70 wt % of styrenes, (B) 10–50 wt % of acrylic acid and/or methacrylic acid and (C) 3 to 20 wt % of sulphonic acid group containing monomer, along with (D) less than 30 wt % of other monomer copolymerizable with (A)–(C). The copolymer has an mw of 2,000 to 100,000, and is used, on a solid basis as its water soluble salt, at ratios of 1 to 20 parts/weight against 100 parts/weight of the resin on a solid basis. The emulsifier permits rosin esters, terpene resins or petroleum resins to be emulsified into emulsions in the form smaller uniform particles, with improved stability and water resistance as well as reduced foaming property, being useful in the production of paints, adhesives, etc.

Whilst many sizing compositions are known there is constantly a need for improved sizing compositions capable of imparting improved print characteristics to paper, for example improved definition and colour integrity from ink jet printers.

There is also a need to provide sizing compositions which facilitate simpler, more economical and environmentally acceptable paper making processes. The manufacture of paper typically involves preparation of a cellulose pulp furnish comprising approximately 99% water, which has to be removed by drainage, suction, pressing and drying. The furnish, successively, flows onto an open mesh wire, where approximately 90% of the water is removed by free drainage and suction, followed by pressing between rollers and finally drying on heated drying cylinders. The water content of the "dry" paper is of the order of 0–10%, typically approximately 5%. The "dry" paper product can undergo further production processes or be reeled and used. Processes at this stage refer to treatments at the "dry end" of the paper machine. Surface sizing refers to the process in which sizing materials are applied to the paper surface in a sizing press at the dry end of the process and may be followed by further drying on heated drying cylinders. The "dry" end of the paper making process refers to the sizing press and subsequent stages of the process. In order to reduce the consumption of water in the paper making process it is desirable to recycle water. Recycling of water, however, leads to a build up of spent chemicals and pulp components (which interfere with sizing) and an increase in water temperature (which accelerates side reactions which interfere with the paper chemicals' normal function). These effects can be reduced by applying sizing agents at the dry end of the paper making process, using size press techniques, e.g., puddle press, coating bill blades and film presses. There is therefore a need for sizing agents capable of application to paper at a "dry" stage in the paper making process.

SUMMARY OF THE INVENTION

According to the present invention there is provided a sizing composition comprising a thermoplastic resin. According to a further aspect of the present invention there is provided a method of sizing paper comprising use of a thermoplastic resin. There is also provided a paper product sized with a thermoplastic resin.

According to one embodiment, the sizing composition comprises a thermoplastic resin selected from the group consisting of thermoplastic rosins having an acid number less than 50, thermoplastic hydrocarbon resins, thermoplastic polyamides and thermoplastic amide waxes.

According to a preferred embodiment, the sizing composition comprises a thermoplastic rosin wherein the rosin has an acid number less than 50.

Preferably, the rosin comprises a natural rosin, fortified rosin, dimerized rosin, hydrogenated rosin, disproportionated rosin, esterified rosin or mixture thereof. According to more preferred embodiments, the rosin comprises an esterified rosin the rosin comprises a pentaerythritol ester of rosin and/or the thermoplastic rosin has an acid number in the range 9 to 16.

According to another preferred embodiment, the sizing composition comprises a thermoplastic hydrocarbon resin.

Preferably, the thermoplastic resin has a dropping point in the range 50 to 150° C., more preferably in the range 80 to 120° C., and more preferably 95 to 110° C.

Preferably, the sizing composition comprises a surfactant, more preferably an anionic surfactant, and most preferably the surfactant is sodium lignosulphonate.

Preferably, the sizing composition comprises a colloidal polymer. Preferably, the colloidal polymer is starch, most preferably cationic starch.

The invention is also directed to a method of sizing paper comprising use of any of the sizing compositions described above.

In the paper making process, the paper goes through a drying stage. Typically the paper is dried by contact with a heated drying cylinder. Preferably, the thermoplastic resin has a dropping point corresponding to the temperature of the drying process $^{+}/_{-}20°$ C., more preferably $^{+}/_{-}5°$ C.

Preferably, the sizing is carried out at a pH greater than 5.5, more preferably the pH is 5.6–9, and most preferably the pH is 7–9.

Preferably, the size is used at a level of about 0.01 wt % to about 2 wt % based upon the dry weight of the paper web.

Preferably, the sizing agent is employed as a surface size. More preferably the sizing composition is applied at a dry stage in the paper making process.

Preferably, the sizing composition is applied to paper by a size press technique followed by heating.

The invention is also directed to a method of sizing paper comprising use of a composition comprising a thermoplastic rosin, wherein the sizing takes place substantially in the absence of alum. Preferably, the sizing takes place substantially in the absence of an aluminium-based fixing agent. Most preferably, the sizing agent is employed as a surface size.

The processes are preferably carried out using the preferred resins and additives described above.

The invention is also directed to paper sized with the above described sizing compositions and made by the above described processes.

DETAILED DESCRIPTION OF THE INVENTION

The thermoplastic resin employed in the present invention may comprise any resin exhibiting thermoplasticity namely, the property of softening and flowing upon application of heat. The property of thermoplasticity is defined with reference to standard procedures for measuring softening point and dropping point described herein. Thermoplastic resins include rosins, hydrocarbon resins, polyamides and amide waxes.

Rosins

Most conventional acid sizing agents are based on rosin. Conventionally, the development of sizing with a rosin-based size is dependent upon its reaction with an aluminum-based fixing agent capable of forming an aluminum rosinate, typically papermaker's alum, aluminum sulphate, $Al_2(SO_4)_3$, with various amounts of water of hydration. Other similar equivalent well-known aluminum compounds, such as aluminum chloride, aluminum chlorohydrate, polyaluminum chlorides, and mixtures thereof, may also be used. Rosin and alum or its equivalents complex either in the wet end of the papermaking system or during elevated temperature drying to form aluminum rosinate, which renders the paper hydrophobic. Since aluminum species that exist predominantly at a low pH (about <pH 6) are required for the appropriate interactions needed to effect sizing, rosin and alum have been used primarily in acid papermaking systems. It has been shown that, by proper selection of addition points in the papermaking system and by using cationic dispersed rosin sizes, rosin-based sizes can be used in papermaking systems up to about pH 7, thus extending the range of acid sizes.

However, due to the limitations imposed by alum chemistry, the efficiency of rosin-based sizes decreases above about pH 5.5.

It is a feature of the present invention that thermoplastic rosins can act as sizing agents substantially in the absence of aluminum-based fixing agents. Preferably, the compositions of the present invention are also free of other soluble highly charged cations, such as $Fe^{3+}$, which can also act as fixing agents.

Thus, according to the present invention there is provided a method of sizing paper comprising use of a composition comprising a thermoplastic rosin, wherein the sizing takes place substantially in the absence of alum. Preferably the sizing takes place substantially in the absence of aluminium based fixing agents. More preferably, the sizing takes place in the absence of cationic fixing agents.

According to a further aspect of the present invention there is provided a method of sizing paper comprising use of a thermoplastic rosin wherein sizing is conducted at a pH of greater than 5.5, preferably in the range of 5.6 to 9, more preferably in the range 7 to 9.

The rosin useful for the present invention can be any thermoplastic rosin suitable for sizing paper, including unfortified rosin, fortified rosin and extended rosin, as well as rosin esters, acid modified rosin esters, polymerised rosin, dimerized rosin, disproportionated rosin, hydrogenated (preferably partially to highly hydrogenated) rosin and hydrogenated (preferably partially to highly hydrogenated) rosin esters; and mixtures and blends thereof.

The rosin used in this invention can be any of the commercially available types of rosin, such as wood rosin, gum rosin, tall oil rosin, or mixtures of any two or more, in their crude or refined state. Wood rosin is preferred. Partially hydrogenated rosins and polymerized rosins, as well as rosins that have been treated to inhibit crystallization, such as by heat treatment or reaction with formaldehyde, also can be employed.

A fortified rosin useful in this invention is the adduct reaction product of rosin and an acidic compound containing the

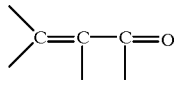

group and is derived by reacting rosin and the acidic compound at elevated temperatures of from about 150° C. to about 210° C.

The amount of acidic compound employed will be that amount which will provide fortified rosin containing from about 1% to about 16% by weight of adducted acidic compound based on the weight of the fortified rosin. Methods of preparing fortified rosin are well known to those skilled in the art. See, for example, the methods disclosed and described in U.S. Pat. Nos. 2,628,918 and 2,684,300, the disclosures of which are incorporated herein by reference.

Examples of acidic compounds containing the

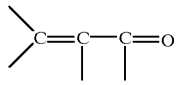

group that can be used to prepare the fortified rosin include the α-β-unsaturated organic acids and their available anhydrides, specific examples of which include fumaric acid, maleic acid, acrylic acid, maleic anhydride, itaconic acid, itaconic anhydride, citraconic acid and citraconic anhydride. Mixtures of acids can be used to prepare the fortified rosin if desired. Thus, for example, a mixture of the acrylic acid adduct of rosin and the fumaric acid adduct can be used to prepare the novel dispersions of this invention. Also, fortified rosin that has been substantially completely hydrogenated after adduct formation can be used.

Various rosin esters of a type well known to those skilled in the art can also be used in the present invention. Suitable exemplary rosin esters may be rosin esterified as disclosed in the U.S. Pat. Nos. 4,540,635 (Ronge et al.) or 5,201,944 (Nakata et al.), the disclosures of which are incorporated herein by reference.

The unfortified or fortified rosin or rosin esters can be extended if desired by known extenders therefor such as waxes (particularly paraffin wax and microcrystalline wax); hydrocarbon resins including those derived from petroleum hydrocarbons and terpenes; and the like. This is accomplished by melt blending or solution blending with the rosin or fortified rosin from about 10% to about 100% by weight, based on the weight of rosin or fortified rosin, of the extender.

Also blends of fortified rosin and unfortified rosin; and blends of fortified rosin, unfortified rosin, rosin esters and rosin extender can be used. Blends of fortified and unfortified rosin may comprise, for example, about 25% to 95% fortified rosin and about 75% to 5% unfortified rosin. Blends of fortified rosin, unfortified rosin, and rosin extender may comprise, for example, about 5% to 45% fortified rosin, 0 to 50% rosin, and about 5% to 90% rosin extender.

In general, it has been found that the dropping point of the rosin is dependent upon the acid number of the rosin. "Acid number" is defined as the number of milligrams of potassium hydroxide (KOH) required to neutralise a gram of rosin (see ASTM D 803-61). The acid number may range from 0 to 320. In the present invention it is preferred that the rosin has an acid number of less than 100, more preferably less than 50, more preferably less than 25, more preferably in the range 9 to 16.

Particularly preferred rosins for use in the present invention comprise esterified rosins. Esterified rosins comprise esters formed from any of the above mentioned rosins, including hydrogenated rosin, and an alcohol. Suitable alcohols include polyhydric alcohols (such as glycol, glycerol, ethylene glycol, diethylene glycol, triethylene glycol, pentaerythritol, 1,4-butanediol, sorbitol and mannitol), aminoalcohols (such as triethanolamine, triisopropanolamine and tributanolamine), and polyethylene and polypropylene glycols. Preferably, the rosin comprises the pentaerythritol ester or glycerol ester of rosin. Preferably the rosin comprises the pentaerythritol ester of rosin.

Hydrocarbon Resins

Any suitable thermoplastic hydrocarbon resin or mixtures thereof may be employed in the present invention. The products commonly referred to as hydrocarbon resins are low molecular weight, thermoplastic polymers derived from cracked petroleum distillates, turpentine fractions, coal tar, or various pure olefinic monomers. (See Volume 12, pages 852–869, entitled "Hydrocarbon Resins" by J. F. Holohan, Jr., J. Y. Penn, W. A. Vredenburgh contained in *Kirk-Othmer Encyclopedia of Chemical Technology*, 3rd edition, (1980), the contents of which are incorporated herein by reference).

Coal-tar hydrocarbon resins are typically derived from coumarone-indene. Terpene resins are typically derived from α-pinene, and d-limonene or dipentene mixtures from sulphate turpentine. Pure monomer resins are typically made from α-methylstyrene, styrene, vinyltoluene, isobutylene, and compounds with similar structure.

Feed streams for petroleum resins are derived from the deep cracking of petroleum distillates and can be classified as follows:

(1) $C_4$—$C_5$—$C_6$ (commonly referred to as C5) aliphatic streams containing varying amounts of piperylene, isoprene, and various other monoolefins, such as isoamylene (2-methyl-2-butene), isobutylene (2-methylpropene) and cyclopentene.

(2) $C_8$—$C_9$—$C_{10}$ (commonly referred to as C9) aromatic streams containing indene, methylindene vinyltoluene isomers, styrene, α-methylstyrene, β-methylstyrene, and dicyclopentadiene in varying amounts, in addition to various ethyl-, divinyl- and polymethyl-benzenes. Methyl and higher homologues of these monomers are also believed to be present.

(3) Dicyclopentadiene (DCPD) and cyclopentadiene (CPD) and methylcyclopentadiene streams.

Other hydrocarbon resins which may be of use include resins obtained by catalytic alkylation of poly-unsaturated hydrocarbon monomer and polycyclic aromatic compound as taught in U.S. Pat. No. 5,391,670 and resins obtained from dicyclopentadiene based diolefin and vinyl aromatic hydrocarbon by thermal polymerization as taught in U.S. Pat. No. 5,502,140; polyalkylene waxes, such as polyethylene and polypropylene waxes; polymers and copolymers of vinyl functional aromatic monomers, such a α-methyl Styrene which can be polymerised by Friedel-Craft reaction to low molecular weight resins having the required dropping point; polymers of pentadiene, cyclopentadiene and dicyclopentadiene. Hydrogenated hydrocarbon resins may also be used.

It will be appreciated that the dropping point of the hydrocarbon resin will be dependent upon the monomer(s) on which the resin is based and the degree of polymerisation. Modification of the properties of the hydrocarbon resin by modification of the monomer and degree of polymerisation is within the ability of a person skilled in the art.

Other Resins

Other thermoplastic resins suitable for use in the present invention include polyamides, such as Evacor 824 (Laporte); amide waxes, such as stearamide. Promoter resins, including cationic resins and polymers as retention aids are also useful in the present invention. Examples include polydiamino dimethyl ammonium chloride resins, polyamine resins, polyethyleneimine resins and dicyandiamide formaldehyde ammonium chloride resins. Such resins are particularly useful as internal sizes.

Other Components

The sizing compositions of the present invention may also comprise other components to assist in the paper making process (e.g., to minimise deposits in the paper making machinery, or to reduce breaks in the paper), or to improve or modify the properties of the paper.

A feature of the present invention is that the thermoplastic resins of the invention can be incorporated in the paper making process at the same stage as colloidal polymers, such as starch, which improve the surface properties of the paper. Conventionally, starch is added to the paper separately from the sizing agent.

Thus, according to a preferred embodiment, the sizing compositions of the present invention also comprise a colloidal polymer, preferably a polysaccharide, more preferably a natural polysaccharide such as starch. It has been found that use of about 12½ parts starch to 100 parts resin by weight also assists in the dispersal and stability of the resin in water. However, compositions containing up to at least 200 parts starch to 100 parts resin can be employed such that separate additional addition of starch during the paper making process is unnecessary.

The starch may comprise a natural, anionic, oxidized, cationic, amphoteric or modified starch. Examples of starches from potato, corn and waxy maize include:

| | | |
|---|---|---|
| anionic potato starch | Perfectamyl 4692 | ex Avebe |
| cationic potato starch | Amylofax 15 | ex Avebe |
| hydroxy ethylated potato starch (neutral) | Sofarex | ex Avebe |
| cationic waxy maize starch | Hicat 21370 | ex Roquette |
| cationic waxy maize starch | Stalok J140 | ex Staley |
| oxidised corn starch (anionic) | Stayco C | ex Staley |
| oxidised corn starch (anionic) | Stayco M | ex Staley |
| oxidised corn starch (anionic) | Stayco AD | ex Staley |
| Cationic waxy maize starch | Stalok J169 | ex Staley |

Modified starches are described in, for example, European Patent Application EP-A-0056876. The starch may be natural starch or may be degraded to achieve the desired viscosity. Preferably, the starch is a cationic starch, more preferably cationic waxy maize starch.

In addition to starch, suitable polysaccharide colloids include carboxy methyl cellulose (CMC), hydroxy ethyl cellulose, hydroxy propyl cellulose, guar, pectin, carrageenin and mixtures thereof.

The compositions of the present invention may also comprise a surfactant (surface active agent). Any suitable surfactant may be used including sodium lignosulphonate, alkyl aryl sulphonic acids and ethylene oxide adduct derivatives (e.g. sodium lauryl sulphate, nonyl phenol E-9 EO sulphate), nonyl phenol polyglycol ether (9EO phosphate), sulphosuccinate salts of dialkyl esters of sulphosuccinic acid (e.g., sodium dioctyl ester), sulphosuccinamates (stearyl sodium salt), casein, Kymene resins (Kymene is a registered trademark of Hercules Incorporated), rosin soaps, phosphate esters. Preferably, the composition comprises an anionic surfactant, preferably sodium lignosulphonate. Sodium lignosulphonate is preferably used in combination with starch.

Anionic surface active agents are well known in the art. In carrying out this invention a suitable anionic surface active agent is a soap, such as the sodium soap, of a rosin-base material of which the dispersion is comprised. Other suitable anionic dispersing agents include salts of alkylaryl sulphonic acids, salts of condensed naphthalene sulphonic acids, salts of dialkyl esters of sulfosuccinic acid, salts of alkyl half esters of sulphuric acid, and salts of alkylphenoxy-(polyethyleneoxy)ethanol half esters of sulphuric acid.

The rosin soap can be prepared separately and added to the composition or it can be formed in situ by addition of a base, such as sodium hydroxide, potassium hydroxide or ammonium hydroxide to the composition of which the fortified rosin is comprised. Sodium soap of fortified rosin is the preferred anionic surface active agent and it is preferred that it be formed in situ by addition of sodium hydroxide.

In the case of the alkyl aryl sulfonates, the alkyl group may be linear or branched with ten to eighteen carbon atoms. Various mixtures of these alkylaryl sulfonates can be used. The preferred aryl group is phenyl. Sodium alkylbenzene sulfonates are available commercially. One commercially available product is Ultrawet DS. (Ultrawet is a trademark of Arco Chemical Company.) Condensed naphthalene sulphonic acid salts are products prepared by condensing formaldehyde with naphthylene followed by sulfonation with sulphuric acid and are available commercially. Commercially available products are Tamol SN. and Stepantan A. (Tamol is a trademark of Rohm & Haas Company and Stepantan is a trademark of Stepan Chemical Co.)

In the case of the salts of dialkyl esters of sulfosuccinic acids, the alkyl groups will include cyclohexyl, hexyl, isobutyl, octyl, pentyl and tridecyl. In the case of the salts of half alkyl esters of sulphuric acid, the alkyl group may have ten to eighteen carbon atoms. In the case of the salts of alkylphenoxy-(polyethyleneoxy)ethanol half esters of sulphuric acid, the preferred alkyl group is the nonyl group obtained in propylene trimerization. The polyoxyethylene content can average from one to twenty moles per mole, but an average of four to twelve is preferred.

The compositions of the present invention may also comprise, or be used in combination with, other agents typically used in paper making. These agents, which may be added in amounts and using techniques known to those skilled in the art of papermaking, include: antifoams, for example "Antifoam 426R" (Hercules); optical brightening agents, for example "Blankophor" (Bayer) and "Tinopal" (Geigy); wet strengthening resins, such as epichlorohydrin polyamido resin, for example Kymene SLX® (Hercules) which may be added at the size press, to modify sizing properties; surface glaze agents such as salt (e.g., sodium chloride) solutions; preservatives and biocides (such as 3,5-dimethyl-1,3,5,2H-tetra-hydrothiadiazine-2-thione, e.g., Dazomet or Protectol TOE, added at the rate of 0.06% ar to ar dispersion or 5-chloro-2methyl-4-isothiazolin-3-one (CIT) blended with 2-methyl-4-isothiazolin-3-one (MIT), e.g., Kathon LXE added at 1200 ppm active to ar dispersion.

According to one embodiment the size of this invention is used as a surface size along with internal sizing agents such as an emulsion based upon alkyl or alkenyl ketene dimer (e.g., emulsions based upon Aquapel® 364 alkyl ketene dimer or Precis® 800 alkenyl ketene dimer such as Aquapel® 320, Hercon® 70 and 79, and Precis® 8023, 2000 and 3000 emulsions, available from Hercules Incorporated.)

As used herein, the term "paper" includes all grades of paper and board.

In a further aspect of the present invention there is provided a method of sizing paper comprising applying a thermoplastic resin to the surface of the paper and heating to a temperature corresponding to the dropping point of the resin $^{+}/_{-}20°$ C., preferably $^{+}/_{-}5°$ C.

The sizing composition of the invention may be used in the form of an aqueous dispersion in the manufacture of paper. It may be used as an additive to a papermaking furnish used to manufacture the sized paper. Preferably, the composition of the present invention is applied as a surface treatment by applying it after the paper is formed to the surface of the paper in a size press or other suitable application equipment using application techniques well known to those skilled in the art.

When the composition of the present invention is employed as a size, it is preferred to use about 0.01 wt % to about 2% of the composition based on the dry weight of the paper web.

BRIEF DESCRIPTION OF THE DRAWINGS

The invention will now be described with reference to the following examples and figures in which.

A: colour to colour bleed—five times on different spots

B: composite black optical density

C: black and white optical density

D: black and white feathering—three times on different spots; and

Figure 3:
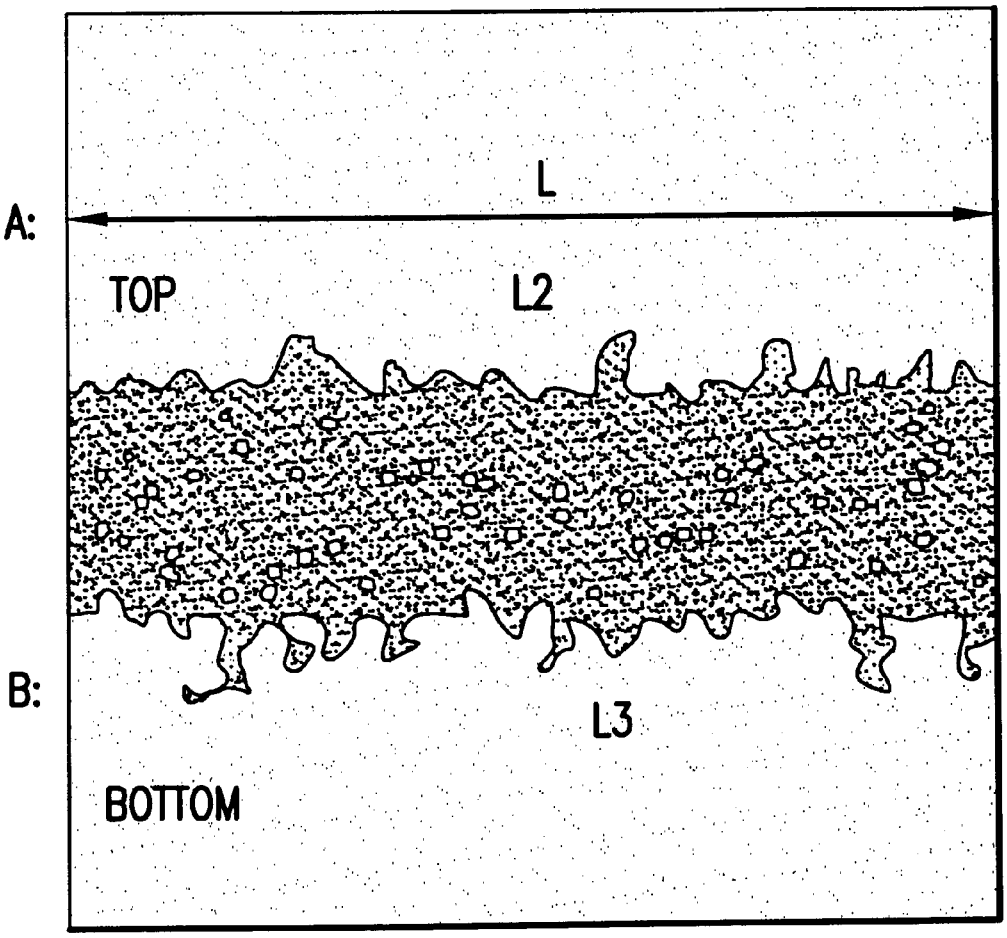

FIG. 3 illustrates colour to colour bleed and black and white feathering evaluations using image analysis:

A:* colour to colour bleed black and white feathering:Rt=L2/L; Rb=L3/L; width=# black pixels/L.

B:* poorer colour to colour bleed and black and white feathering:higher ratio or larger width.

The invention is described by way of example only. It will be appreciated that modification of detail may be made without departing from the scope of the invention.

Softening Point and Dropping Point

As used herein the terms "softening point" and "dropping point" refer to temperatures (0° C.) determined using a Mettler Toledo FP83 measuring cell and FP90 central processor.

The dropping point is defined as the temperature at which the first drop of a melted sample of the substance under investigation flows through the 2.8 mm diameter bottom orifice of a standard dropping point sample cup on slow heating (1° C./min), where the starting temperature was at least 15° C. below dropping point.

The softening point is defined as the temperature at which the sample softens on slow heating (1° C./min) in a standard softening point sample cup and flows 20 mm out of the 6.35 mm sample cup opening. (Starting temperature at least 15° C. below softening point).

The thermoplastic properties of the resins may also be characterised with reference to the glass transition temperature (Tg) which may be measured according to standard procedures. Tg values for thermoplastic resins are typically 50–60° C. lower than the dropping point.

Sizing and Printability

Resins, in dispersed form, have been compared as surface sizes against two products: Scripset® 740 (Hercules Inc) and Basoplast 400D (BASF), which are commercial surface sizes for multi-purpose office paper.

The effectiveness of a material for sizing at the surface of paper is the sum of its ability to size, not only against water and water borne media but also the other liquids, that will contact it during for example ink jet printing, with multicolour print. Here it is a requirement that primary inks will wet the paper fibre and flow and mix in a controlled process. The control needed is logically applied to the operation, by the electronic control and mechanics of the printing head and timing of the deposition of the individual ink jets. The criteria for ink jet printability has been set by Hewlett Packard with their method, "Hewlett-Packard, Paper Acceptance Criteria for the HP Deskjet 500C, 550C and 560C Printers, second edition Jul. 1, 1994 San Diego Calif.". The performance requirements are measured by image analysis. The same technique is used to measure the performance of black on white print.

Currently applied test methodology breaks the requirements into three parts:

1. sizing against water,
2. the measurement of ink jet print qualify by image analysis of printed paper surfaces.
3. optical density Surface Sizing All the surface sizes, in the form of solutions or colloidal dispersions were added to starch carrier solutions and applied to the surface of paper at a size puddle press or size coater. The starch carrier is typically Perfectamyl 4692A ex Avebe. The sizes were applied to the paper at 0.2% db. The base sheets that the surface sizes are applied to can vary from unsized to moderately sized quality. When measured, on the HST scale, the range 0–10 to approx 150 seconds is possible. The HST (Hercules sizing tester) scale is in seconds and is a measure of the time taken for a coloured test solution to penetrate into and through paper. The procedure is defined in Tappi Method T503 pm-89. The results are given in the Table 1.

Figure 1:
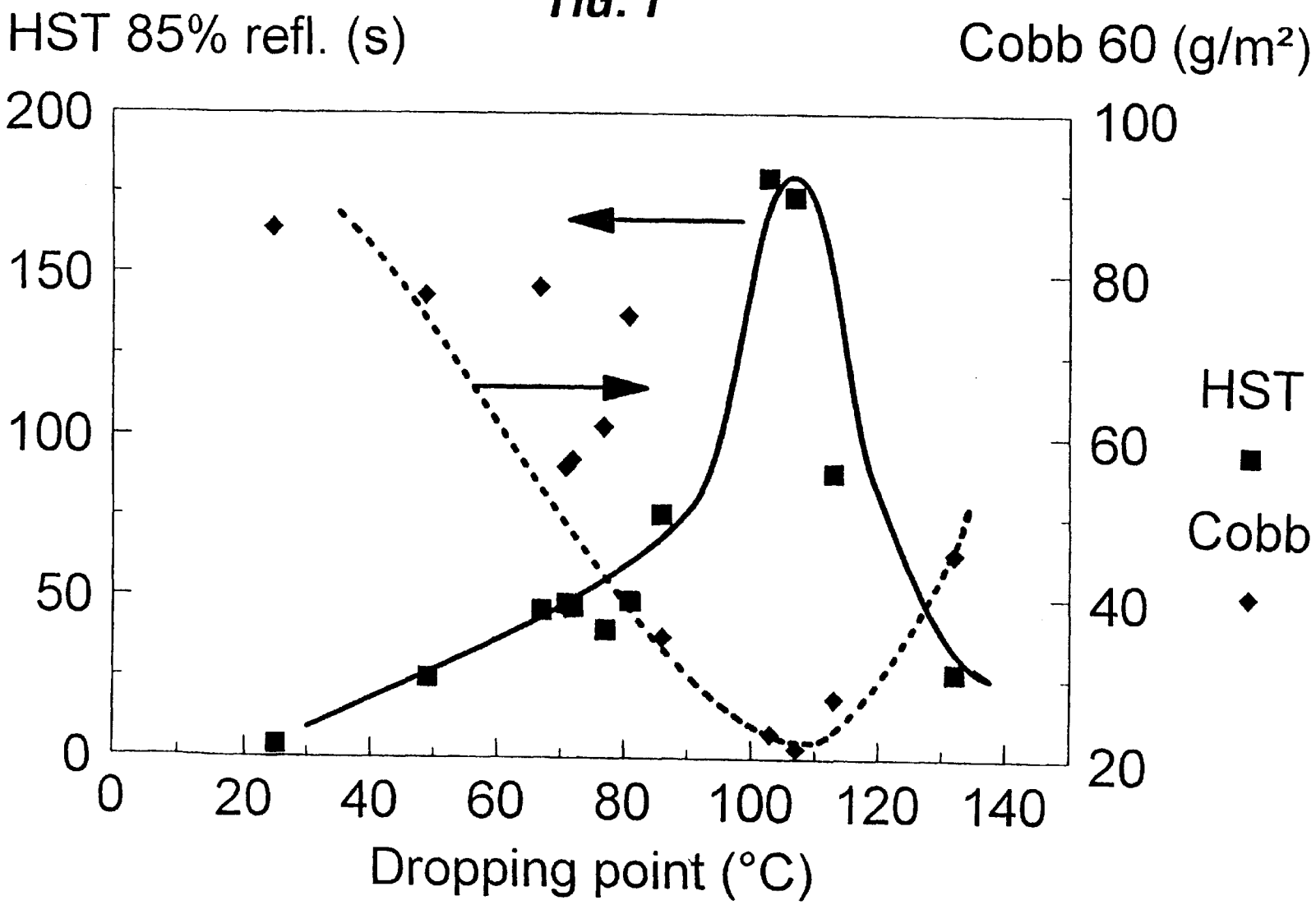
FIG. 1 illustrates sizing efficiency as a function of resin softening.

The relationship between sizing performance and the dropping point of the resin has been illustrated in FIG. 1 and Table 1. Sizing efficiency, of the resins, in the form of water borne dispersions and currently acceptable industry standards were measured after application onto the surface of paper. The sizing performance, for different paper drying temperatures correlated with the dropping point of the resin. The paper drying temperature was determined by the temperature of the size press drier. Normally steam was used to heat drying cylinders after the size press and temperatures of cylinder surfaces and paper surfaces were in the range 100 to 110° C. However, surface temperatures may be modified to below 100° C. or above 110° C. by use of alternative methods of heating. Under the conditions used to generate the data in Table 1 the drier surface temperature was 105° C. and resins with dropping points of 80 to 120° C., more particularly 100 to 115° C. gave a good sizing response and resins outside this range gave a progressive decrease in sizing performance. Sizing is the creation of a water resistant low energy surface on the cellulose fibre. It is believed that the mechanism whereby dispersed thermoplastic resins contribute to sizing is by softening in the drier section and flowing over the surface of cellulose fibres to form a hydrophobic film. There will therefore be a need for products with different dropping points, to cater for paper machines with different drying profiles.

The industry standards were a water borne solution of a styrene maleic anhydride copolymer (Scripset® sizing agent, available from Hercules Incorporated) and a styrene acrylate copolymer latex (Basoplast). Dropping point data are not applicable, in both cases the polymer has too high a molecular weight. The mechanism for the formation of a water repellent sizing film from the non-resinous materials are believed to be different. The solution of styrene maleic anhydride copolymer precipitates as a film as it dries. The copolymer styrene-acrylate dispersion forms a film, by coalescence, as it dries.

TABLE 1

Surface Sizing Performance and Resin Softening Point

| Resin | Softening Point (deg C) | Dropping Point (deg C) | HST (sec) |
|---|---|---|---|
| rosin methyl ester (Example 5) | liquid at room temp. | liquid at room temp. | 4 |
| Disproportionated rosin acid (Example 6) | 45 | 49 | 25 |

TABLE 1-continued

Surface Sizing Performance and Resin Softening Point

| Resin | Softening Point (deg C) | Dropping Point (deg C) | HST (sec) |
|---|---|---|---|
| hydrogenated rosin ester (Example 7) | 70 | 71 | 48 |
| disproportionated rosin ester (Example 8) | 70 | 72 | 47 |
| hydrogenated hydrocarbon resin blended with rosin methyl ester (Example 9) | 70 | 77 | 40 |
| C9 hydrocarbon resin blended with rosin acid | 75 | 100 | 49 |
| C5 hydrocarbon resin (Example 11) | 80 | 86 | 76 |
| pentaerythritol ester of rosin (Example 1) | 100 | 100 | 180 |
| blended hydrocarbon resin and pentaerythritol ester rosin (Example 10) | 110 | 113 | 89 |
| styrene acrylate copolymer (eg Basoplast 400D) (COMPARATIVE) | polymeric | polymeric | 184 |
| styrene maleic anhydride copolymer solution in water (COMPARATIVE) | polymeric | polymeric | 192 |
| glycerol ester of rosin (Example 12) | 91 | | 120 |
| MBG 275 (Example 13) | 110 | | 131 |
| terpene hydrocarbon resin (Example 14) | 85 | | 125 |
| terpene hydrocarbon resin (Example 15) | 125 | | 119 |
| terpene hydrocarbon resin (Example 16) | 115 | | 114 |
| coumarone indene hydrocarbon resin (Example 17) | 113 | | 88 |
| coumarone indene hydrocarbon resin (Example 18) | 124 | | 93 |

Printability, Ink Jet Printing Colour and Black and White Print

Data showing the comparative performance of Hercules resin dispersions and two products in commercial use, for print related criteria are given in Tables 2–5.

Figure 2:
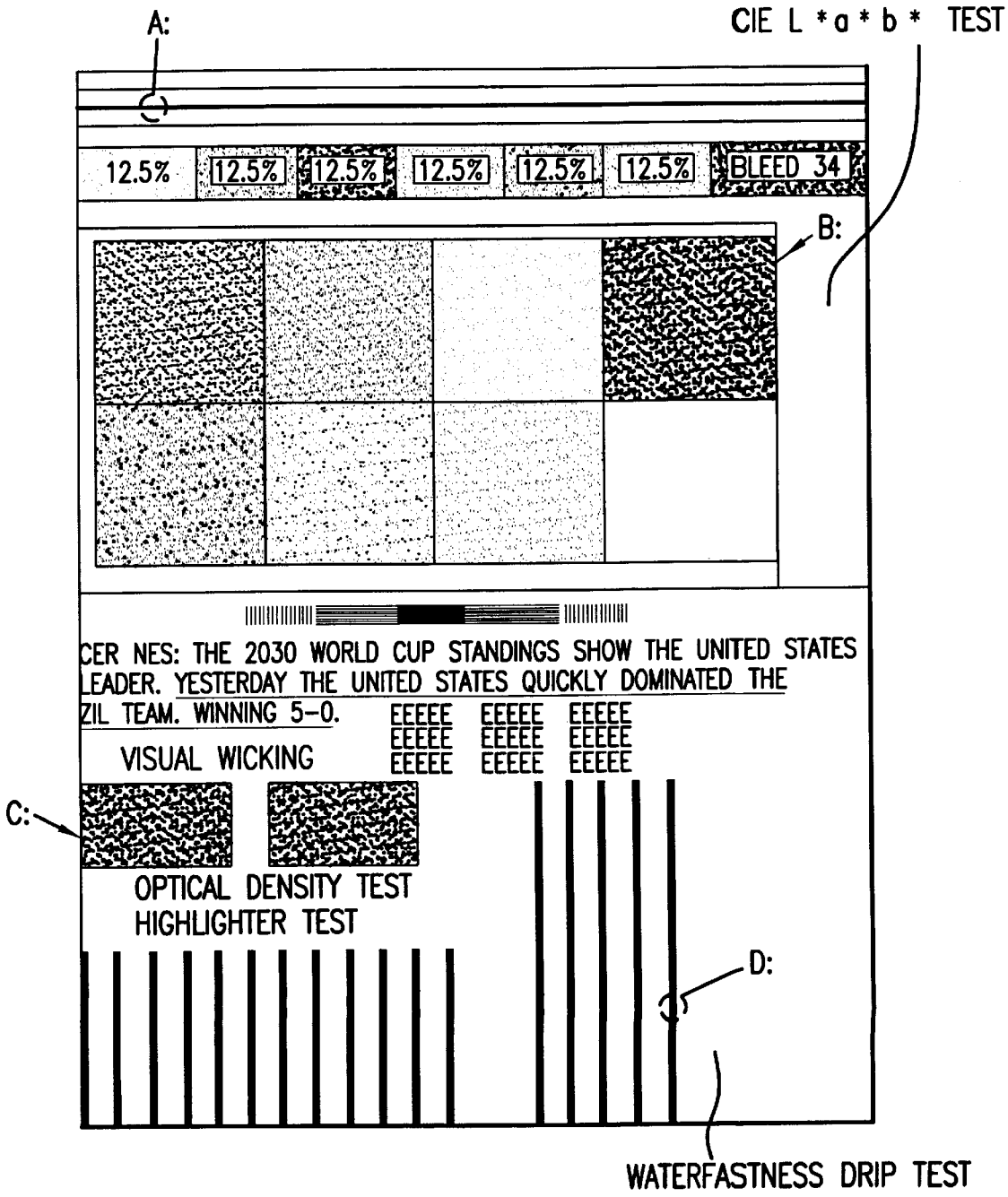
FIG. 2 illustrates the Hewlett Packard black and white and colour evaluation test sheet; performance was tested by image analysis, for colour to colour bleed and black and white feathering (A and D) and by densitometry for optical density (B and C)

The paper was sized as described in the previous section and then printed with the HP standard format for print in their criteria, with an HP Deskjet 560C, see FIG. 2. Image analysis was performed with Kontron KS 400 Image Analysis Software, run on a computer, connected to a Zeiss Stereomicroscope Stemi 2000-C, equipped with a video camera.

Table 2 gives the results of ink jet colour printing performance, (measured by the quality of colour to colour bleeding).

TABLE 2

Ink Jet Print Performance, Colour To Colour Bleeding

| Resin/polymer | Ratio at top (Rt) | Ratio at bottom (Rb) | Width (number of Pixels) |
|---|---|---|---|
| C5 hydrocarbon | 2.03 | 1.94 | 295.28 |
| pentaerythritol ester of rosin | 2.01 | 1.88 | 297.54 |
| blended hydrocarbon resin and pentaerythritol ester rosin | 1.83 | 1.73 | 296.73 |
| starch only | 2.02 | 2.01 | 314.92 |

TABLE 2-continued

| Resin/polymer | Ink Jet Print Performance, Colour To Colour Bleeding Ratio at top (Rt) | Ratio at bottom (Rb) | Width (number of Pixels) |
|---|---|---|---|
| (COMPARATIVE) | | | |
| styrene acrylate copolymer (eg Basoplast 400D) (COMPARATIVE) | 2.34 | 1.96 | 310.43 |
| styrene maleic anhydride copolymer solution in water (COMPARATIVE) | 2.08 | 1.97 | 292.56 |
| glycerol ester of rosin | 1.93 | 1.94 | 294.92 |
| C9 partially hydrogenated hydrocarbon resin | 1.82 | 1.89 | 292.27 |
| terpene hydrocarbon resin (beta pinene S85) | 1.79 | 1.97 | 292.55 |
| terpene hydrocarbon resin (alpha pinene A125) | 1.73 | 1.84 | 291.27 |
| terpene hydrocarbon resin (alpha pinene A115) | 2.01 | 2.11 | 293.67 |
| coumarone indene hydrocarbon resin (C100) | 1.73 | 2.28 | 294.21 |
| coumarone indene hydrocarbon resin (C110) | 1.90 | 1.88 | 299.70 |

In this test the lateral spread of pigments is measured as a ratio of the real length of the boundary between two print interfaces and the straight line measured along the same boundary. This is illustrated in FIG. 2. The ratio is measured at the top(Rt) and bottom(Rb) of the printed areas, the top being the position of the letter or line in relation to the printing head. The width reported is the band width of the printed area measured in pixels. Higher values indicate more spreading and thus more diffuse printing quality. The results show, that the subject materials of this invention are at least equal and in some cases better, in performance than industry standards.

Black and White Printing

The feathering of black pigment on paper was measured by image analysis using the accepted industry standards of Hewlett Packard for their ink jet printers HP Deskjet 500C, 550C and 560C. In this test the lateral spread of pigment is measured as a ratio of the real length of the boundary between two print interfaces and straight line measured along the same boundary. This is illustrated in FIG. 3. The ratio is measured at the top(Rt) and bottom(Rb) of the printed areas, the top being the position of the letter or line in relation to the printing head. Higher values indicate more feathering or spreading and thus more diffuse printing quality. For the data in Table 3, location A in the Hewlett Packard print reference sheet (illustrated in FIG. 2) was used. For the data in Table 4, the wider band at location D in the print reference sheet was used.

TABLE 3

| Resin/polymer | Black And White Printing Ratio at the top (Rt) | Ratio at the bottom (Rb) | Width (number of pixels) |
|---|---|---|---|
| C5 hydrocarbon | 1.21 | 1.35 | 54 |
| pentaerythritol ester of rosin | 1.45 | 1.13 | 57 |
| blended hydrocarbon resin and pentaerythritol ester of rosin | 1.27 | 1.32 | 59 |
| starch only (COMPARATIVE) | 1.43 | 1.57 | 68 |
| styrene acrylate copolymer (eg Basoplast 400D) (COMPARATIVE) | 1.30 | 1.21 | 61 |
| styrene maleic anhydride copolymer solution in water (COMPARATIVE) | 1.29 | 1.32 | 57 |

TABLE 4

| Resin/polymer | Black And White Printing Ratio at the top (Rt) | Ratio at the bottom (Rb) | Width number of pixels |
|---|---|---|---|
| starch only (COMPARATIVE) | 1.40 | 1.46 | 324 |
| styrene acrylate copolymer (eg Basoplast 400D) (COMPARATIVE) | 1.17 | 1.31 | 316 |
| styrene maleic anhydride copolymer solution in water (COMPARATIVE) | 1.15 | 1.36 | 225 |
| glycerol ester of rosin | 1.20 | 1.39 | 317 |
| C9 partially hydrogenated hydrocarbon resin | 1.23 | 1.36 | 320 |
| terpene hydrocarbon resin (beta pinene S85) | 1.27 | 1.53 | 321 |
| terpene hydrocarbon resin (alpha pinene A125) | 1.31 | 1.35 | 323 |
| terpene hydrocarbon resin (alpha pinene A115) | 1.22 | 1.58 | 319 |
| coumarone indene hydrocarbon resin (C100) | 1.30 | 1.50 | 323 |
| coumarone indene hydrocarbon resin (C110) | 1.47 | 2.01 | 327 |

The results show that the performance of the thermoplastic rosin ester, hydrocarbon and mixture of the two are similar in performance to the industry standards.

Optical Density

The intensity of composite black print on paper and the migration of black pigment through paper was measured by optical density. Optical densities were measured with a Gretag 182 Densitometer.

In this test the optical density of composite black print formed on the surface of paper is measured and the optical density of the pigment migrating through the paper to the underside is measured. Composite black pigment is the black colour printed by the combination of all the pigments in the inkjet head of the 500, 550 560 series Hewlett Packard printers. Higher values are indicative of improved quality. On the paper surface this defines the "blackness" or clarity of the image. On the reverse side of the paper the value is indicative of colour penetration through the paper (bleed through) and zero is an optimum result. The results indicate that the performance of the thermoplastic resins is similar to the industry standards.

TABLE 5

Optical Density, Composite Black At Paper Surface And Migration To The Underside

| Resin/polymer | Composite black (Hewlett Packard criteria) | Ink (pigment) migration through paper |
|---|---|---|
| C5 hydrocarbon | 1.19 | 0.26 |
| pentaerythritol ester of rosin | 1.13 | 0.33 |
| blended hydrocarbon resin and pentaerythritol ester rosin | 1.12 | 0.27 |
| starch only (COMPARATIVE) | 1.13 | 0.22 |
| styrene acrylate copolymer (eg Basoplast 400D) (COMPARATIVE) | 1.21 | 0.23 |
| styrene maleic anhydride copolymer solution in water (COMPARATIVE) | 1.17 | 0.21 |
| glycerol ester of rosin | 1.12 | 0.29 |
| C9 partially hydrogenated hydrocarbon resin | 1.09 | 0.32 |
| terpene hydrocarbon resin (beta pinene S85) | 1.07 | 0.27 |
| terpene hydrocarbon resin (alpha pinene A125) | 1.09 | 0.39 |
| terpene hydrocarbon resin (alpha pinene A115) | 1.11 | 0.30 |
| coumarone indene hydrocarbon resin (C100) | 1.10 | 0.31 |
| coumarone indene hydrocarbon resin (C110) | 1.11 | 0.30 |

Black and White Pigment Density and Bleed Through

The test methods described in the previous section were applied to black and white print, the results are shown in Table 6. The performance of the thermoplastic resins is equal or better than the industry standards.

TABLE 6

Black And White Optical Density And Bleed Through

| Resin/polymer | Surface Optical Density | Bleed Through |
|---|---|---|
| C5 hydrocarbon | 1.67 | 0.07 |
| pentaerythritol ester of rosin | 1.58 | 0.09 |
| blended hydrocarbon resin and pentaerythritol ester rosin | 1.42 | 0.11 |
| starch only (COMPARATIVE) | 1.49 | 0.11 |
| styrene acrylate copolymer (eg Basoplast 400D) (COMPARATIVE) | 1.62 | 0.09 |
| styrene maleic anhydride copolymer solution in water (COMPARATIVE) | 1.60 | 0.09 |
| glycerol ester of rosin | 1.52 | 0.12 |
| C9 partially hydrogenated hydrocarbon resin | 1.39 | 0.11 |
| terpene hydrocarbon resin (beta pinene S85) | 1.36 | 0.15 |
| terpene hydrocarbon resin (alpha pinene A125) | 1.45 | 0.12 |
| terpene hydrocarbon resin (alpha pinene A115) | 1.45 | 0.11 |
| coumarone indene hydrocarbon resin (C100) | 1.39 | 0.10 |
| coumarone indene hydrocarbon resin (C110) | 1.38 | 0.11 |

Machine Runnability

It is important that deposits do not form and build up in the system during paper making. Deposits cause imperfections in the paper, sediment in pipes and pumps. In severe cases, deposits will cause paper breaks and pipework blockages. It has been shown in simulated running conditions, that tendencies to deposit formation can be minimized by the selection of the stabilizing surfactant and polymer system. The results show, that dispersions stabilized with sodium lauryl sulphate and rosin soaps, without starch, will form deposits; that stabilization with phosphate ester surfactants, without starch, will run successfully for long periods of time; and that mixtures of starch and sodium lignosulphonate will protect against deposit formation indefinitely.

Dispersion Preparation

Suitable methods for the preparation of surface and internal sizes of this invention include high shear mixing and inversion.

In the preparation of a dispersion by high shear mixing, the resin was heated to achieve a viscosity low enough to allow for turbulent mixing to break the resin into colloidal sized droplets. For example, the pentaerythritol ester of rosin, commercially available from Hercules Incorporated as Pentalyn H and Pentalyn HE, was heated to 185–195° C. and vigorously mixed with a solution of stabilizing solution. The process was preferably performed under pressure, in two stages utilizing high shear static or high speed mixers, followed by droplet size reduction in a pressurized valve homogenizer (e.g., of the Manton Gaulin type). Alternatively, the resin was dissolved in organic solvent, such as dichloromethane, toluene, methyl tert.butyl ether etc., and then mixed at conditions of high shear and high turbulence, with an aqueous solution of the stabilizing solution. Thereafter the dispersion was subjected to homogenization or ultrasonic agitation to further reduce the size of the droplets. The organic solvent was removed by evaporation. After emulsification the size of the droplets was preferably about one micron diameter.

The following examples illustrate preparative processes, for dispersions suitable for the sizing and printing applications reported previously. Unless otherwise indicated proportions of components are by weight.

EXAMPLE 1

Pentalyn® H was melted in a vessel fitted with means for heating and stirring and raised to a temperature of 185–195° C. An aqueous solution of cationic waxy maize starch (Stalok J140) and sodium lignosulphonate, was prepared, which on mixing with Pentalyn H gave a size dispersion having a dry basis content of Pentalyn H, starch and sodium lignosulphonate in the ratio of 100 to 12.5 to 6.25 parts. The aqueous solution of the starch and lignisolphonate was prepared at a total solids content of 7–8%, preheated under pressure to 145–160° C. and mixed with the resin in a pressurized system to give a dispersion with a total solids content of 34–36%. The product prepared in the first stage mixing process was refined, to reduce the droplet diameter to 1–2 microns, in a valve homogenizer, of the Manton Gaulin type.

EXAMPLE 2

Pentalyn® H (70 parts) and fortified rosin (30 parts) were melted in a vessel fitted with means for heating and stirring and raised to a temperature of 185–195° C. An aqueous solution of cationic waxy maize starch (Stalok J140) and sodium lignosulphonate was prepared, which on mixing with the resin (Pentalyn H plus fortified rosin) gave a size dispersion having a dry basis content of resin, starch and sodium lignosulphonate in the ratio of 100 to 12.5 to 6.25 parts. The aqueous solution of starch and lignosulphonate was prepared at a total solids content of 7–8%, preheated under pressure to 145–160° C. and mixed with the resin in a pressurized system to give a dispersion with a total solids content of 34–36% total solids. The product prepared in the first stage mixing process was refined, to reduce the droplet diameter to 1–2 microns, in a valve homogenizer, of the Manton Gaulin type.

The fortified rosin in this example was made by reacting fumaric acid (8 parts) with tall oil rosin (92 parts) at 180–200° C. for two hours. The rosin used to prepare the fortified rosin can, however, be any of the commercially available types of rosin, such as wood rosin, gum rosin, tall oil rosin or mixtures of two or more in their crude or refined state.

EXAMPLE 3

Pentalyn® H was dissolved in methyl tert.butyl ether to make a 50% total solids solution. An aqueous solution of cationic waxy maize starch (Stalok J140) and sodium lignosulphonate was prepared, which on mixing with the Pentalyn H solution in methyl tert.butyl ether, will give a size dispersion having a dry basis content of Pentalyn H, starch and sodium lignosulphonate in the ratio of 100 to 12.5 to 6.25 parts. The aqueous phase of starch and sodium lignosulphonate was prepared at a total solids content of 7–8%. The resin solution and the starch/lignosulphonate solution were blended with a high shear mixer (a Waring blender or Ultra-Turrax stirrer) for 3–5 minutes, followed by homogenization with a valve homogenizer or ultra sonic mixer, to a droplet diameter of 1–2 microns. The solvent was removed from the dispersion under reduced pressure using a rotary evaporator. The solids content of the dispersion was 34–36% after solvent removal.

EXAMPLE 4

Pentalyn® H was melted in a vessel fitted with means for heating and stirring and raised to a temperature of 185–195° C. A solution lauryl sulphate in water, was prepared which on mixing with the Pentalyn H gave a dispersion with a dry basis content, of Pentalyn H and lauryl sulphate, in the ratio of 100 to 6.0 parts, in a dispersion of 34–35% total solids. The surfactant solution was heated under pressure 145–160° C. and mixed with the resin to prepare a dispersion of 34–35% total solids. The product prepared in the first stage mixing process was refined to reduce the droplet diameter to 0.8–1.6 microns, in a valve homogenizer of the Manton Gaulin type.

General Procedure for Preparation of Resin Dispersions by Inversion

In the inversion process for making dispersions, water is added gradually to the resin and in the emulsification process, at the first stage, a water in oil emulsion forms which inverts to an oil in water emulsion as the volume of the water phase increases. This method for making size dispersions is referred to in U.S. Pat. No. 4,983,257.

Preparation by the inversion process involves preheating the resin to a point at which it is sufficiently mobile to mix with an aqueous solution of the surfactant and colloidal polymer solution. A water in oil emulsion forms which inverts to an oil in water emulsion as the volume of water phase increases. With resins that have dropping points below 110° C. this process can be done in unpressurized vessels. Resins with dropping points above 110° C. require closed and pressurized vessels.

EXAMPLE 5

Rosin Methyl Ester Dispersion

A vessel was charged with the liquid methyl ester of rosin (acid number <20, 100 parts) (commercially available as Abalyn® from Hercules Incorporated) at room temperature and surfactant (nonyl phenol polyglycol ether (9EO-phosphate) 5 parts) was added and dissolved by stirring. The temperature was maintained at 25–30° C. and water (80 parts) was added gradually at the rate of 10 parts per minute, to make an emulsion by the inversion process. A process in which a water in oil emulsion forms which inverts to an oil in water emulsion as the volume of the water phase increases.

EXAMPLE 6

Rosin Acid Dispersion using Disproportionated Rosin

Disproportionated rosin is available commercially (e.g., from Abrieta Chemie as Resin 731D and Akzo Nobel by as Burez). Disproportionated rosin is rosin in which the abietic acid content has been converted to dehydroabietic acid. (See: Natural resins, Barendrecht and Lees, Ullmanns Encyclopedia der Teechnischen Chemie and U.S. Pat. No. 5,175,250).

Disproportionated rosin (100 parts) (Resin 731D—Abrieta) was heated to liquefy it in a kettle at 120° C. and surfactant (nonyl phenol polyglycol ether (9EO) phosphate 7 parts and triethanolamine 2.0 parts) was added and mixed in for 15 minutes. The temperature was reduced to 90–99° C. Water (108 parts) was heated to 90–99° C. and added gradually to the liquid rosin, at a rate of 10 parts per minute. The emulsion formed by the inversion process. A water in oil emulsion forms which inverts to an oil in water emulsion as the volume of the water phase increases. The dispersion was cooled to room temperature.

EXAMPLE 7

Hydrogenated Rosin Ester

Hydrogenated rosin, esterified with glycerol (drop point 70° C., acid number <20, 45 parts) (commercially available as Staybelite® from Hercules Incorporated), was charged to a vessel fitted with means for heating and stirring and melted and heated to raise the temperature to 160–170° C. A solution of surfactants (nonyl phenol polyglycol ether (9EO) phosphate 5 parts and amine dodecyl benzene sulphonate 5 parts), was prepared in water (50 parts). The solution of surfactants was heated to 145–155° C. in a pressurized system and mixed with the molten rosin under high shear followed by refining to a lower droplet diameter (approximately 1 micron), in a valve homogenizer, of the Manton Gaulin type, at 200 bar pressure.

EXAMPLE 8

Rosin Ester Dispersions Using Disproportionated Rosin

Disproportionated rosin, esterified with glycerol (drop point 70° C., acid number <20, 100 parts) (commercially available as MBG 105 from Hercules Incorporated) was heated to liquefy it in a kettle at 120° C. and surfactant (nonyl phenol polyglycol ether (9EO) phosphate 7 parts and triethanolamine (1.4 parts) was added and mixed in for 15 minutes. The temperature is reduced to 90–99° C. Water (108 parts) was heated to 90–99° C. and added gradually to the liquid rosin, at a rate of 10 parts per minute. The emulsion formed by the inversion process. A water in oil emulsion forms which inverts to an oil in water emulsion as the volume of the water phase increases. The dispersion was cooled to room temperature.

EXAMPLE 9

Hydrogenated Hydrocarbon Resin/Rosin Methyl Ester Dispersions

Hydrogenated hydrocarbon resin (C9 type, drop point 100° C. 65 parts) (commercially available as Regalite® from Hercules Incorporated) and hydrogenated rosin glycerol ester (drop point 70° C., acid number <20, 35 parts) (commercially available as Staybelite® from Hercules Incorporated) were mixed by adding the hydrocarbon resin to rosin ester, previously melted and stirred at 120° C. Surfactant (nonyl phenol polyglycol ether (9EO) phosphate), 8 parts and triethanolamine, 1.7 parts) were added and dissolved in the liquid resin mixture. The mixture was cooled to 90–99° C. and water (110 parts) at 90–95° C. was added gradually, at a rate of 10 parts per minute. A water in oil emulsion forms which inverts to an oil in water emulsion as the volume of the water phase increases. The dispersion was cooled to room temperature.

EXAMPLE 10

Modified Pentaerythritol Ester of Rosin/ Hydrocarbon C5 Resin Dispersion

The modified pentaerythritol ester of rosin (Pentalyn 856) was blended with a C5 hydrocarbon resin (drop point 100° C.) (commercially available as Hercules® C from Hercules Incorporated) to give a mixed resin with a drop point of 113° C.

The mixed resin was cut back with toluene (20%) and warmed to 45° C. and surfactant (sodium lauryl sulphate 3.1%) was mixed in during 10 minutes. Water (total 43%) was added. 7% of the water as a first portion and mixed in during 20 minutes. The remaining water was added in aliquots of 3% and cooled to 25° C. Biocide (0.05% 1,2-benzisothiazolin-3-one) was added to the finished dispersion.

EXAMPLE 11

C5 Hydrocarbon Resin

Tacolyn® 100, a C5 hydrocarbon resin commercially available from Hercules Incorporated was employed.

EXAMPLE 12

Glycerol Ester of Rosin

Permalyn 5095 (drop point 91° C.) (commercially available from Hercules) was dissolved in methyl tert. butyl ether to make a 50% total solids solution. An aqueous phase of cationic waxy maize starch (Hicat 21370) (Hicat 21370 is commercially available from Roquette and equivalent to Stalok J140) and sodium lignosulphonate was prepared, which on mixing with the Permalyn 5095 solution in methyl tert. butyl ether, will give a dry basis content of Permalyn 5095, starch and sodium lignosulphonate in the ratio of 100 to 12.5 to 6.25 parts. The aqueous phase of starch and sodium lignosulphonate was prepared at a total solids content of 7–8%. The resin solution and the starch/ lignosulphonate were blended with a high shear mixer (a Waring blender or Ultra-Turrax stirrer) for 3–5 minutes, followed by homogenization with a valve homogenizer or ultra sonic mixer, to a droplet diameter of 1–2 microns. The solvent was removed from the dispersion under reduced pressure using a rotary evaporator. The solids content of the dispersion was 34–36% after solvent removal.

EXAMPLE 13

(C9 Hydrocarbon Resin Partially Hydrogenated)

MBG 275 (drop point 110° C.) (Hercules) was dissolved in methyl tert. butyl ether to make a 50% total solids solution. An aqueous phase of cationic waxy maize starch (Hicat 21370) and sodium lignosulphonate was prepared, which on mixing with the MBG 275 solution in methyl tert. butyl ether, will give a dry basis content of MBG 275, starch and sodium lignosulphonate in the ratio of 100 to 12.5 to 6.25 parts. The aqueous phase of starch and sodium lignosulphonate was prepared at a total solids content of 7–8%. The resin solution and the starch/lignosulphonate were blended with a high shear mixer (a Waring blender or Ultra-Turrax stirrer) for 3–5 minutes, followed by homogenization with a valve homogenizer or ultra sonic mixer, to a droplet diameter of 1–2 microns. The solvent was removed from the dispersion under reduced pressure using a rotary evaporator. The solids content of the dispersion was 38–40% after solvent removal.

EXAMPLE 14

(Terpene Hydrocarbon Resin)

Piccolyte S85 (drop point 85° C.), a terpene (beta pinene) hydrocarbon resin sold by Hercules Inc. was dissolved in methyl tert. butyl ether to make a 50% total solids solution. An aqueous phase of cationic waxy maize starch (Hicat 21370) and sodium lignosulphonate was prepared, which on mixing with the Piccolyte S85 solution in methyl tert. butyl ether, give a dry basis content of Piccolyte S85, starch and sodium lignosulphonate in the ratio of 100 to 12.5 to 6.25 parts. The aqueous phase of starch and sodium lignosulphonate was prepared at a total solids content of 7–8%. The resin solution and the starch/lignosulphonate were blended with a high shear mixer (a Waring blender or Ultra-Turrax stirrer) for 3–5 minutes, followed by homogenization with a valve homogenizer or ultra sonic mixer, to a droplet diameter of 1–2 microns. The solvent was removed from the dispersion under reduced pressure using a rotary evaporator. The solids content of the dispersion was 33–35% after solvent removal.

EXAMPLE 15

(Terpene Hydrocarbon Resin)

Piccolyte A 125 (drop point 1250° C.), a terpene (alpha pinene) hydrocarbon resin sold by Hercules Inc. was dissolved in methyl tert. butyl ether to make a 50% total solids solution. An aqueous phase of cationic waxy maize starch (Hicat 21370) and sodium lignosulphonate was prepared, which on mixing with the Piccolyte A125 solution in methyl tert. butyl ether, give a dry basis content of Piccolyte A 125, starch and sodium lignosulphonate in the ratio of 100 to 12.5 to 6.25 parts. The aqueous phase of starch and sodium lignosulphonate was prepared at a total solids content of 7–8%. The resin solution and the starch/lignosulphonate were blended with a high shear mixer (a Waring blender or Ultra-Turrax stirrer) for 3–5 minutes, followed by homogenization with a valve homogenizer or ultra sonic mixer, to a droplet diameter of 1–2 microns. The solvent was removed from the dispersion under reduced pressure using a rotary evaporator. The solids content of the dispersion was 36–38% after solvent removal.

EXAMPLE 16

(Terpene Hydrocarbon Resin)

Piccolyte A 115 (drop point 115° C.), a terpene (alpha pinene) hydrocarbon resin sold by Hercules Inc. was dissolved in methyl tert. butyl ether to make a 50% total solids solution. An aqueous phase of cationic waxy maize starch (Hicat 21370) and sodium lignosulphonate was prepared, which on mixing with the Piccolyte A 115 solution in methyl tert. butyl ether, give a dry basis content of Piccolyte A 115, starch and sodium lignosulphonate in the ratio of 100 to 12.5 to 6.25 parts. The aqueous phase of starch and sodium lignosulphonate was prepared at a total solids content of 7–8%. The resin solution and the starch/lignosulphonate were blended with a high shear mixer (a Waring blender or Ultra-Turrax stirrer) for 3–5 minutes, followed by homogenization with a valve homogenizer or ultra sonic mixer, to a droplet diameter of 1–2 microns. The solvent was removed from the dispersion under reduced pressure using a rotary evaporator. The solids content of the dispersion was 36–38% after solvent removal.

EXAMPLE 17

(Coumarone Indene Hydrocarbon Resin)

Novares C100 (drop point 113° C.), a coumarone indene hydrocarbon resin sold by Vft Ag. was dissolved in methyl tert. butyl ether to make a 50% total solids solution. An aqueous phase of cationic waxy maize starch (Hicat 21370) and sodium lignosulphonate was prepared, which on mixing with the Novares C100 solution in methyl tert. butyl ether, give a dry basis content of Novares C100, starch and sodium lignosulphonate in the ratio of 100 to 12.5 to 6.25 parts. The aqueous phase of starch and sodium lignosulphonate was prepared at a total solids content of 7–8%. The resin solution and the starch/lignosulphonate were blended with a high shear mixer (a Waring blender or ultra-Turrax stirrer) for 3–5 minutes, followed by homogenization with a valve homogenizer or ultra sonic mixer, to a droplet diameter of 1–2 microns. The solvent was removed from the dispersion under reduced pressure using a rotary evaporator. The solids content of the dispersion was 38–40% after solvent removal.

EXAMPLE 18

(Coumarone Indene Hydrocarbon Resin)

Novares C110 (drop point 124° C.), a coumarone indene hydrocarbon resin sold by Vft Ag. was dissolved in methyl tert. butyl ether to make a 50% total solids solution. An aqueous phase of cationic waxy maize starch (Hicat 21370) and sodium lignosulphonate was prepared, which on mixing with the Novares C110 solution in methyl tert. butyl ether, give a dry basis content of Novares C110, starch and sodium lignosulphonate in the ratio of 100 to 12.5 to 6.25 parts. The aqueous phase of starch and sodium lignosulphonate was prepared at a total solids content of 7–8%. The resin solution and the starch/lignosulphonate were blended with a high shear mixer (a Waring blender or Ultra-Turrax stirrer) for 3–5 minutes, followed by homogenization with a valve homogenizer or ultra sonic mixer, to a droplet diameter of 1–2 microns. The solvent was removed from the dispersion under reduced pressure using a rotary evaporator. The solids content of the dispersion was 32–34% after solvent removal.

It will be appreciated that the invention is described by way of example only and modification of detail may be made without departing from the scope of the invention.

We claim:

1. A surface sizing composition comprising an aqueous dispersion comprising: (a) at least one thermoplastic resin selected from the group consisting of thermoplastic rosins having an acid number less than 50, thermoplastic hydrocarbon resins, thermoplastic polyamides and thermoplastic amide waxes; (b) cationic starch; and (c) surfactant.

2. The surface sizing composition according to claim 1 wherein the aqueous dispersion comprises a thermoplastic rosin having an acid number less than 50.

3. The surface sizing composition according to claim 2 wherein the rosin comprises a natural rosin, fortified rosin, dimerized rosin, hydrogenated rosin, disproportionated rosin, esterified rosin, or a mixture thereof.

4. The surface sizing composition according to claim 3 wherein the thermoplastic resin has a dropping point in the range of 80 to 120° C.

5. The surface sizing composition according to claim 2 wherein the rosin comprises an esterified rosin.

6. The surface sizing composition according to claim 2 wherein the rosin comprises a pentaerythritol ester of rosin.

7. The surface sizing composition according to claim 2 wherein the thermoplastic rosin has an acid number in the range of 9 to 16.

8. The surface sizing composition according to claim 1 wherein the aqueous dispersion comprises a thermoplastic hydrocarbon resin.

9. The surface sizing composition according to claim 1 wherein the thermoplastic resin has a dropping point in the range of 50 to 150° C.

10. The surface sizing composition according to claim 1 wherein the thermoplastic resin has a dropping point in the range of 80 to 120° C.

11. The surface sizing composition according to claim 1 wherein the thermoplastic resin has a dropping point in the range of 95 to 110° C.

12. The surface sizing composition according to claim 1 wherein the surfactant is an anionic surfactant.

13. The surface sizing composition according to claim 1 wherein the surfactant is sodium lignosulfonate.

14. The surface sizing composition according to claim 1 wherein the cationic starch is cationic waxy maize starch.

15. The surface sizing composition according to claim 1 wherein the thermoplastic resin is esterified rosin having a dropping point in the range of 50 to 150° C., the surfactant is sodium lignosulfonate, and the cationic starch is cationic waxy maize starch.

16. The surface sizing composition according to claim 15 further comprising casein.

17. The surface sizing composition according to claim 1 further comprising casein.

* * * * *